US006186122B1

(12) United States Patent
Leung

(10) Patent No.: US 6,186,122 B1
(45) Date of Patent: Feb. 13, 2001

(54) SNAP-LOCK RETAINER FOR A FUEL INJECTOR

(75) Inventor: Johnny Leung, Newport News, VA (US)

(73) Assignee: Siemens Automotive Corporation, Auburn Hills, MI (US)

( * ) Notice: Under 35 U.S.C. 154(b), the term of this patent shall be extended for 0 days.

(21) Appl. No.: 09/343,754

(22) Filed: Jun. 30, 1999

(51) Int. Cl.[7] ..... F02M 55/02
(52) U.S. Cl. ..... 123/470
(58) Field of Search ..... 123/468, 469, 123/470, 456, 472

(56) References Cited

U.S. PATENT DOCUMENTS 5,301,647 * 4/1994 Lorraine ..... 123/470
5,724,946 * 3/1998 Franchitto ..... 123/470
5,752,487 * 5/1998 Harrell et al. ..... 123/470
6,019,089 * 2/2000 Taylor et al. ..... 123/470

* cited by examiner

*Primary Examiner*—Thomas N. Moulis

(57) ABSTRACT

A fuel injector assembly comprises a fuel injector having an inlet end and an outlet end, and further having an associated fuel rail assembly. An o-ring seal is located approximately at the inlet end to prevent fluid from leaking out of the fuel injector and the fuel rail assembly. A groove in the inlet end is located above the o-ring seal, and a retainer member is constructed to be received into the groove to provide positional constraint to the o-ring seal.

8 Claims, 2 Drawing Sheets

SNAP-LOCK RETAINER FOR A FUEL INJECTOR

FIELD OF THE INVENTION

This invention relates generally to fuel injectors of the type that are used to inject liquid fuel into the induction system of an internal combustion engine, and particularly to a means for restricting movement of the o-ring on an injector.

BACKGROUND OF THE INVENTION

An objective of a fuel injector is to accurately deliver fuel to an associated engine or combustion chamber. A control valve controls the injection start and finish by controlling the intake channel of an injection pump. The control valve is provided with a valve body which is in the form of a piston valve and is provided with a valve seat, with a high pressure chamber and a low pressure chamber, respectively, being provided on the two sides of the valve seat. To deliver the predetermined correct quantity of fuel for each combustion event, it is expected that the valve will open and then close precisely.

It is desirable to restrict the movement of the top external o-ring to prevent the o-ring from falling out of the injector during later stages of injector assembly, test, packaging and shipping, as well as during engine assembly and engine servicing. In some current injectors, a retainer is molded simultaneously with the injector body mold. The retainer is used to restrict the movement of the top external o-ring in providing a static seal between the injector and the fuel rail assembly. The retainer is molded around the inlet tube at the top of the injector. Unfortunately, various problems with production mold flash have created a need for a design alternative for the retainer. Once such alternative is to use a metal retainer which is crimped after installation. However, the design and assembly processes of certain injectors types do not readily allow such crimping operation.

It is seen then that there exists a need for a retainer for a fuel injector which is flexible for installation and robust for injector application.

SUMMARY OF THE INVENTION

This need is met by the snap-lock retainer according to the present invention, wherein the retainer is injection molded as a separate component to eliminate the problem of uncontrollable mold flash.

In accordance with one embodiment of the present invention, a fuel injector assembly comprises a fuel injector having an inlet end and an outlet end, and further having an associated fuel rail assembly. An o-ring seal is located approximately at the inlet end to prevent fluid from leaking out of the fuel injector and the fuel rail assembly. A groove in the inlet end is located above the o-ring seal, and a retainer member is constructed to be received into the groove to provide positional constraint to the o-ring seal.

The present invention also provides a method for fabricating a fuel injector assembly. First, a fuel injector body is provided, housed in a fuel injector housing, the fuel injector body having an inlet end and an outlet end. An o-ring seal is located approximately at the inlet end to prevent fluid from leaking out of the fuel injector. A mating component is formed in the inlet end of the fuel injector housing, above the o-ring seal. Finally, a retainer member is received into the mating component to provide positional constraint to the o-ring seal.

For a full understanding of the nature and objects of the present invention, reference may be had to the following detailed description taken in conjunction with the accompanying drawings and the appended claims.

DESCRIPTION OF THE PREFERRED EMBODIMENT

Figure 1:
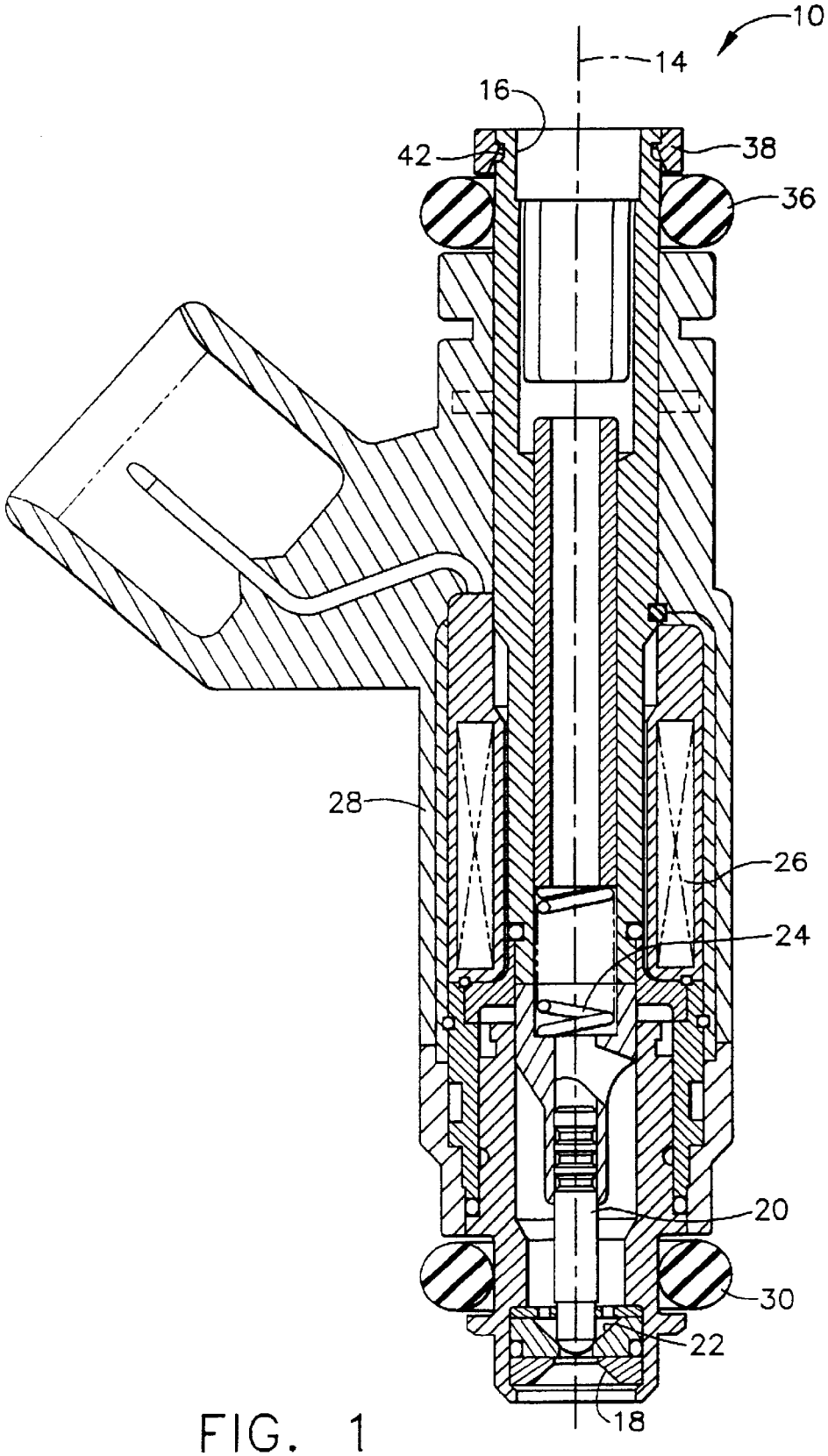
FIG. 1 is a longitudinal cross sectional view through a fuel injector containing the snap-lock retainer in accordance with principles of the present invention.

Referring to FIG. 1 there is illustrated in cross section, a typical molded electrically operated fuel injector 10. Fuel injector 10, shown closed, has a main longitudinal axis 14 and is a top-feed type device comprising an inlet 16 and a nozzle 18 at its opposite axial ends. The passage of liquid fuel through the fuel injector between inlet 16 and nozzle 18 is controlled by the seating and unseating of the rounded tip end of a metal needle 20 on and from a valve seat 22 located just interior of nozzle 18. Needle 20 is resiliently biased by a spring 24 to seat on seat 22, thereby closing the passage to flow. When the valve is electrically energized by the delivery of electric energizing current to its solenoid coil 26, the needle unseats to allow fuel flow. The fuel injector comprises a generally tubular metal housing 28, and axially spaced apart o-rings 30 on the outside of the housing 28 provide for sealing of the fuel injector. In accordance with the present invention, movement of a top external o-ring 36 is restricted by a snap-lock retainer 38.

Figure 2:
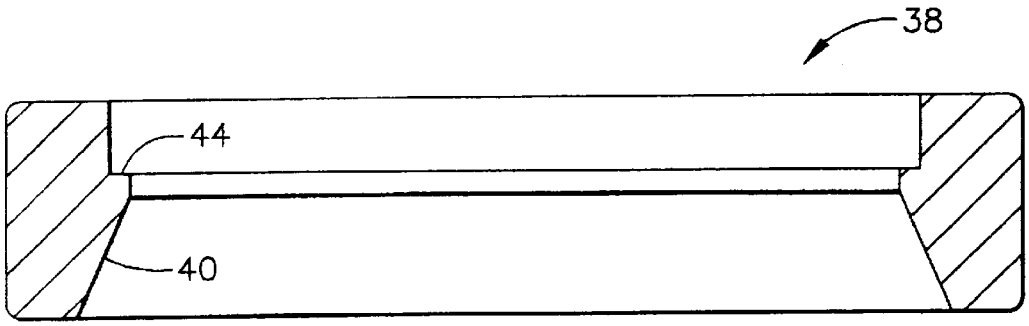
FIG. 2 is a cross sectional view of the snap-lock retainer mechanism of the present invention.
Figure 3:
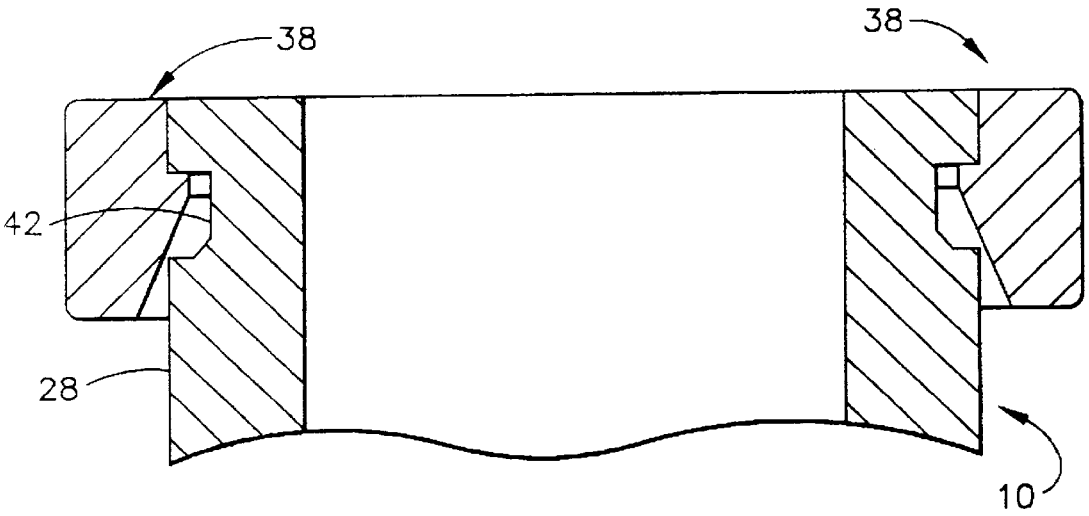
FIG. 3 is an enlarged view of the snap-lock retainer of FIG. 2, as installed in the fuel injector of FIG. 1.

The construction of the retainer member 38 is shown in greater detail in FIGS. 2 and 3. The snap-lock retainer is preferably injection molded as a separate component part, rather than integral with the injector body, to eliminate the currently existing problem of uncontrollable mold flash. The material of the snap-lock retainer 38 is preferably a hard plastic such as commercially available Nylon 6—6, to ensure an appropriate retention force while maintaining the structural integrity desired for installation. The retainer 38 is approximately circular and designed to be received at inlet end 16 of the fuel injector 10.

The retainer or washer-type device 38 is used to provide the positional constraint to an o-ring seal on a multiport fuel injector. The retainer is installed by snapping onto the mating component comprised of the groove 42 formed in the inlet tube 28. A self-locking feature prevents the retainer 38 from unintended disassembly, after installation of the retainer 38 in the groove 42.

The snap-lock retainer 38, shown in FIG. 2, achieves the snapping or gripping feature with a lead-in chamfer 40 which, during installation, forces the retainer to stretch over the inlet tube 28. In a preferred embodiment of the present invention, the snapping feature is achieved with a 47° lead-in chamfer. During installation of the retainer 38, when the retainer reaches groove 42 of the tube 28, shown in FIG. 3, the retainer 38 will spring back to its original diameter, assuming its natural state diameter and shape.

FIG. 3 illustrates the installed position of the retainer 38 on the injector 10 of FIG. 1. The retainer restricts movement of the top external o-ring 36 and provides a static seal between the injector 10 and the fuel rail assembly. When the retainer is molded simultaneously with the injector body, production mold flash problems can occur. The snap-lock retainer 38 of the present invention is molded as a separate component to eliminate the issue of mold flash, and subsequently installed on the injector, as shown in FIG. 3.

Continuing with FIGS. 2 and 3, located at the top of chamfer 40 is a protruded step 44. The protrusion 44 grabs or urges the retainer into the groove 42, thereby providing the retention force required to restrict movement of the retainer 38 and also the o-ring 36.

In accordance with the present invention, and referring to FIGS. 1–3, a fuel injector assembly can be fabricated for restricting movement of the o-ring 36 on the injector 10. The fuel injector 10 body is housed in fuel injector housing 28, and o-ring seal 36 is located approximately at the inlet end to prevent fluid from leaking out of the fuel injector. Mating component 42 is formed in the inlet end 16 of the fuel injector housing, above the o-ring seal 36. The mating component or groove 42 receives retainer member 38, usually by snapping the retainer member onto the groove, to provide positional constraint to the o-ring seal. In a preferred embodiment, the retainer member is molded as a separate component part, separate from the molding of the fuel injector body.

Having described the invention in detail and by reference to the preferred embodiment thereof, it will be apparent that other modifications and variations are possible without departing from the scope of the invention defined in the appended claims.

What is claimed is:

1. A fuel injector assembly comprising:

a fuel injector having a fuel injector housing and further having an inlet end and an outlet end associated with the fuel injector housing;

an o-ring seal located approximately at the inlet end to prevent fluid from leaking out of the fuel injector;

a mating component comprising a groove formed in the inlet end of the fuel injector housing, between the inlet end and the o-ring seal; and a retainer member cooperatively engaging the mating component to provide positional constraint to the o-ring seal.

2. A fuel injector assembly as claimed in claim 1 wherein the retainer member comprises an approximately circular retainer member.

3. A fuel injector assembly comprising:

a fuel injector having a fuel injector housing and further having an inlet end and an outlet end associated with the fuel injector housing;

an o-ring seal located approximately at the inlet end to prevent fluid from leaking out of the fuel injector;

a mating component formed in the inlet end of the fuel injector housing, between the inlet end and the o-ring seal;

a retainer member cooperatively engaging the mating component to provide positional constraint to the o-ring seal; and a lead-in chamfer that forces the retainer member to stretch over the inlet end during installation of the retainer in the mating component.

4. A fuel injector assembly as claimed in claim 3 wherein the lead-in chamfer comprises a protrusion for urging the retainer member to mate with the mating component.

5. A method for fabricating a fuel injector assembly comprising the steps of:

providing a fuel injector body housed in a fuel injector housing, the fuel injector body having an inlet end and an outlet end;

locating an o-ring seal approximately at the inlet end to prevent fluid from leaking out of the fuel injector;

forming a groove in the inlet end of the fuel injector housing, between the inlet end and the o-ring seal; and receiving a retainer member into the groove to provide positional constraint to the o-ring seal.

6. A method as claimed in claim 5 further comprising the steps of:

molding the fuel injector body;

molding the retainer member as a separate component part.

7. A method as claimed in claim 6 wherein the step of molding the retainer member comprises using a resilient material.

8. A method as claimed in claim 5 further comprising the step of snapping the retainer member onto the groove.

* * * * *